US005181005A

United States Patent [19]

Bayer

[11] Patent Number: 5,181,005

[45] Date of Patent: Jan. 19, 1993

[54] THERMAL SWITCH

[75] Inventor: Helmut Bayer, Vienna, Austria

[73] Assignee: Electrovac Fabrikation Elektrotechnischer, Vienna, Austria

[21] Appl. No.: 780,231

[22] Filed: Oct. 22, 1991

[30] Foreign Application Priority Data

Oct. 25, 1990 [AT] Austria ..... 2159/90

[51] Int. Cl.[5] ..... H01H 37/52; H01H 37/54

[52] U.S. Cl. ..... 337/354; 337/365

[58] Field of Search ..... 337/365, 354, 348, 342; 236/48 R

[56] References Cited

U.S. PATENT DOCUMENTS 3,930,215 12/1975 Senor .
4,001,751 1/1977 Deubel ..... 337/365
4,075,596 2/1978 Plasko .
4,109,229 8/1978 Plasko .

FOREIGN PATENT DOCUMENTS 62-86416 4/1987 Japan ..... 236/48
2021865 12/1979 United Kingdom .

*Primary Examiner*—Harold Broome
*Attorney, Agent, or Firm*—Cushman, Darby & Cushman

[57] ABSTRACT

Thermal switch having a thermal bimetallic snap-over disc temperature sensor which interacts via a transmission component with a contact system which has at least one contact carrier carrying or forming a movable contact, the movable contact resting against at least one fixed contact in the quiescent state. In order to ensure that the switch remains in the non-quiescent open position after the thermal sensor has been tripped, provision is made that the movable contact is formed by a wire-type or strip-type contact part which can be plastically deformed by the transmission component actuated by the thermal bimetallic snap-over disc temperature sensor.

11 Claims, 3 Drawing Sheets

THERMAL SWITCH

BACKGROUND OF THE INVENTION

The invention relates to a thermal switch having temperature sensor such as a thermal bimetallic snap-over disc which interacts via a transmission component with a contact system which has at least one contact carrier carrying or forming a movable contact, the movable contact resting against at least one fixed contact in the quiescent state.

Such thermal switches are often used as thermal cut-outs in order to avoid overheating of appliances, but at least to interrupt the power supply to an electrical appliance if said appliance exceeds a certain temperature.

At the same time, various types, such as thermal switches employing solders, switches provided with bimetallic snap-over discs etc., are in use.

The thermal switches employing solders have the disadvantage as temperature cutouts because the switching point can neither be adjusted precisely to a certain temperature nor can this switching temperature be chosen as desired since it depends on the composition of the solder and on the eutectic transition of the latter to the liquid phase.

Temperature sensors such as a bimetallic snap-over disc respond precisely at the desired temperature and the bimetallic snap-over disc may also be so shaped that any desired response temperature can be set. Similar remarks apply to capillary tube sensors having a metallic bellows, and bimetallic strips also exhibit satisfactory results.

Numerous proposed solutions are also known which ensure that a switch once opened remains in the open position. Such a solution is described, for example, in Austrian Patent Specification 374,619. This known solution provides a roller which rolls under the contact carrier when it switches to the open position, with the result that it is not possible to leave the latter.

U.S. Pat, No. 4,075,594 furthermore describes a switch in which a catch slips under a spring, as a result of which a contact is held in the open position after switching to the latter.

A solution is also furthermore known in which a spring slips underneath a bimetallic disc as soon as the latter has snapped out of its quiescent position. Under these conditions, said spring prevents a return of the bimetallic disc to its quiescent position.

Solutions are also furthermore known in which the transmission component is immobilized after the temperature sensor has been tripped.

The disadvantage of these known solutions is that, to immobilize the temperature sensor, the contact carrier or the transmission component, a separate structural part always has to be provided in order to be able to ensure the desired function of preventing the return of the switch to its closed position.

SUMMARY OF THE INVENTION

The object of the invention is to avoid these disadvantages and to propose a thermal switch of the type mentioned at the beginning which ensures that the switch remains in the open position after the thermal sensor has responded.

According to the invention, this is achieved in that the movable contact is formed by a wire-type or strip-type contact part which can be plastically deformed by the transmission component actuated by the temperature sensor.

This ensures that the contacts of the switch remain open after actuation by the transmission component, since it is precisely the movable contact part which can no longer return to its original position, and consequently can no longer come into contact with the fixed contact, because of its plastic deformation. This also makes the provision of a separate structural part unnecessary.

If the contact part of wire-type or strip-type material has itself a spring action, the actuating force chosen must be so high that the spring bending limit of the contact part is exceeded, it being necessary for the opening distance of the point of contact to be larger than the spring-back distance of the sprung wire-type or strip-type material so that it is always ensured that the contact no longer closes.

Provision can furthermore be made that the wire-type or strip-type contact part is in contact in a sprung manner with the fixed contact in the quiescent state. In a further development of the invention, the wire-type or strip-type contact can also be held pressed against the fixed contact by a spring.

These measures ensure contact is reliably made, especially when a contact pressure spring is used if the spring action of the wire-type or strip-type contact part falls markedly even at temperatures situated below the response temperature. If a separate spring is provided, the spring-back distance of the latter must be smaller than the opening distance of the point of contact of the plastically deformed part.

Provision can furthermore be made that the wire-type or strip-type contact part is constructed with at least one weak point; in a further development of the invention, the spring can also be constructed with at least one weak point.

This achieves the result that, in a narrowly limited range, the bending stress adequate for a plastic deformation is reached even at fairly low bending forces. In addition, this also makes it possible to fix the bending point of the wire-type or strip-type contact part or of the spring.

At the response temperature, the force of the snap-over disc has only to be sufficient to ensure a corresponding bending of the movable contact part or of the spring, the displacement distance of the transmission component having to be sufficient to reliably deform the movable contact part, and possibly also the spring, plastically.

Suitable material for the movable, or plastically deformable, contact part is in particular silver, but also copper and brass.

Pure silver has the advantage of a very high conductivity and is suitable in practice especially for high temperatures of up to, for example, approximately 500° C. If the movable contact part is constructed, for example, from pure silver, after some time the silver loses its inherent spring force at relatively low temperatures for example 100° C., because of recrystallization processes so that, preferably, a separate spring for pressing the contact part against the fixed contact can be provided for maintaining the contact pressure.

Instead of pure silver, silver alloys, brass, beryllium/-copper alloys or composite materials such as, for example, silver-plated nickel/beryllium alloys can also advantageously be used.

DETAILED DESCRIPTION OF THE INVENTION

Figure 1:
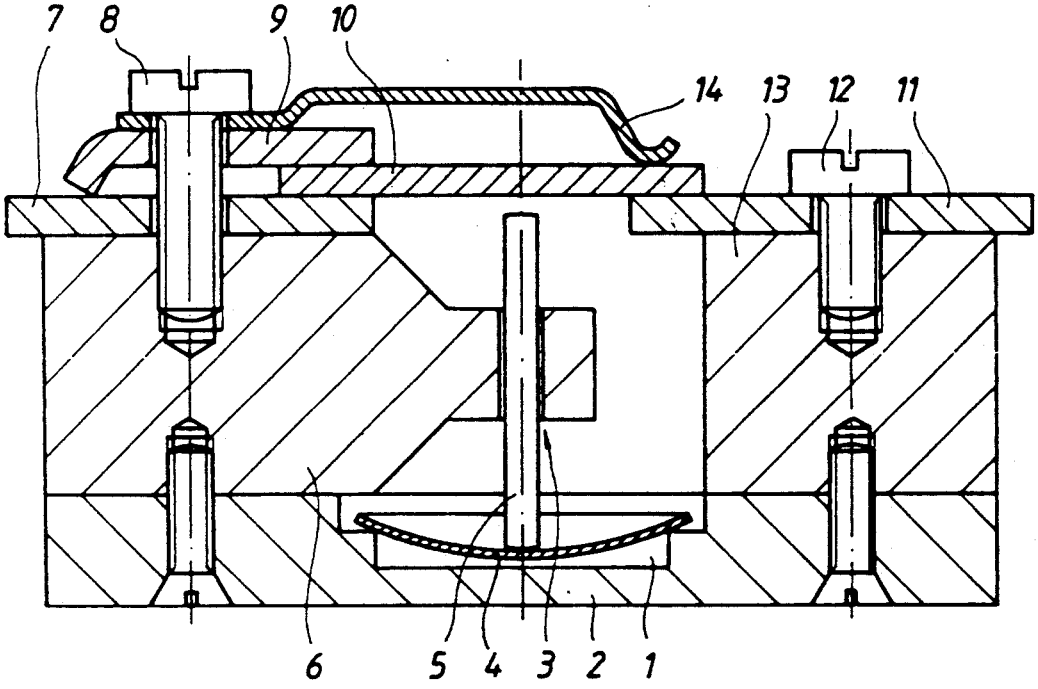
Figure 2:
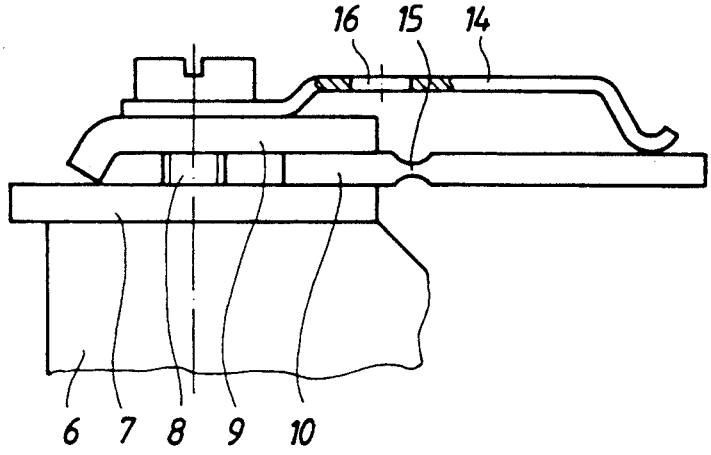
Figure 3:
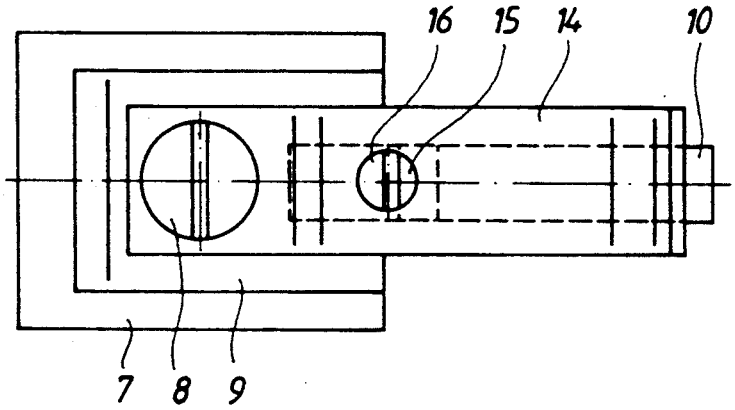
Figure 4:
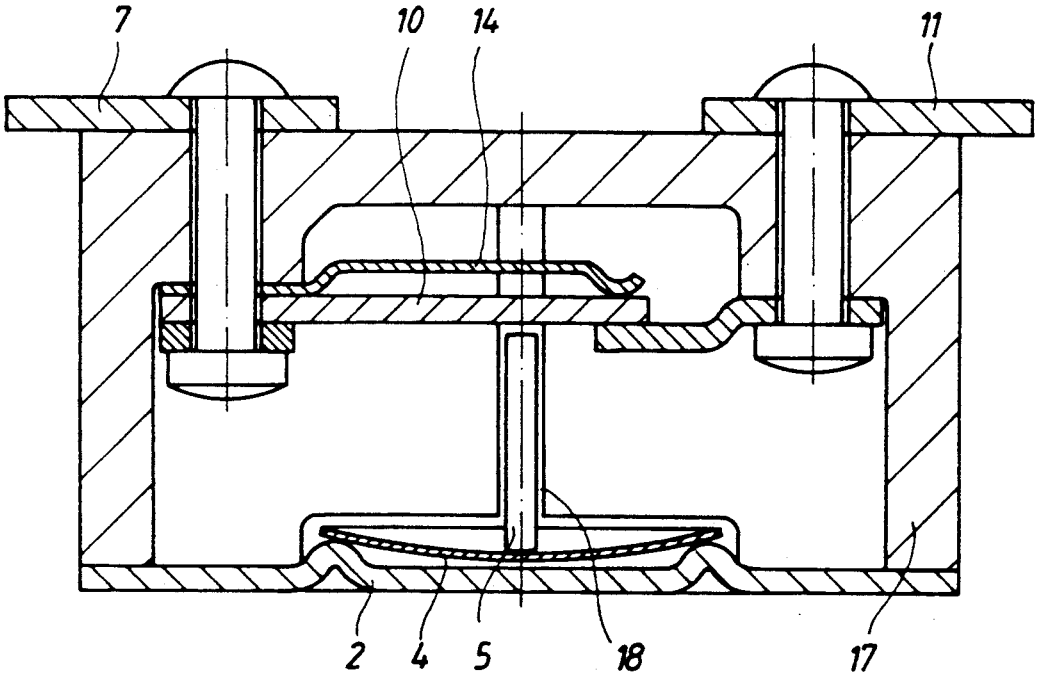

The invention is now explained in greater detail with reference to the drawings. In the drawings:

FIG. 1 shows an embodiment of a switch according to the invention in longitudinal section, FIG. 2 shows an alternatively designed detail of the embodiment according to FIG. 1, partly in cross-section, FIG. 3 shows the detail according to FIG. 2 in plan view, and FIG. 4 shows a further embodiment of a switch according to the invention, also in longitudinal section.

In the embodiment according to FIG. 1, a bimetallic snap-over disc 4 is provided in a recess 1 of a baseplate 2. Resting on said bimetallic snap-over disc 4 is a transmission component 5 which is held in an axially displaceable manner at 3 in a guide 6 joined to the baseplate 2.

Mounted at the top of the guide 6 is a contact 7 which serves to connect a lead which is not shown. Furthermore, both a movable contact part 10, which is of wire-type or strip-type construction, and a spring 14 are clamped with the fixing screw 8, which serves to mount the contact 7, and a clamping piece 9. Said movable contact part 10 is preferably made of silver and the spring, for example, of an Ni/Be alloy.

Said movable contact part 10 rests in the quiescent state of the switch against the second contact 11 provided for connecting a lead which is not shown, as a result of which a conducting connection is made via the movable contact part 10 between the two contacts 7 and 11 serving to connect the leads.

Said contact 11 is also mounted by means of a screw 12 on an insulating part 13 joined to the baseplate 2.

If the response temperature of the bimetallic snap-over disc 4 is now exceeded, it switches from its concave position with respect to the transmission component 5 to a convex one, as a result of which the transmission component 5 is moved upwards and the movable contact part 10 and also the spring 14 are bent upwards, the bending edge running approximately along the clamping point.

At the same time, the deflection of the movable contact part 10 is so dimensioned that the movable contact part 10 is reliably plastically deformed and therefore, after an appropriate cooling of the bimetallic snap-over disc 4 and the return, associated therewith, of the latter to the quiescent position, the movable contact part 10 and the spring 14 only springs back to a negligible extent. This ensures that the conducting connection between the two contacts 7 and 11 remains interrupted.

In the detail, shown in FIG. 2, of the switch according to FIG. 1, the strip-type or wire-type contact part 10 is provided with a weak point 15 in the form of a constriction. This constriction ensures a set bending point. As FIGS. 2 and 3 show, the spring 14 can also be provided with a weak point, for example a perforation 16, which likewise provides a set bending point. The number and form of the weak points can be matched to the respective requirements of the individual application cases.

The further exemplary embodiment, shown in FIG. 4, of a thermal switch according to the invention differs from the embodiment according to FIG. 1, in particular, in that the contact parts are provided in the interior of a housing 17 consisting of insulating material. In this embodiment, the transmission component 5 is guided in lateral grooves 18 which are constructed in the internal wall of the housing. The contact part which can be plastically deformed under the action of the transmission component is denoted by 10 and the spring by 14. Further parts corresponding to the embodiment according to FIG. 1 are provided with identical reference symbols.

In the above, thermal switches according to the invention were described in which the wire-type or strip-type contact part is held pressed against the fixed contact by a spring. It should be expressly pointed out that the invention is not limited to such embodiments with a spring. Embodiments without a spring also come within the invention, it being possible for the wire-type or strip-type contact part itself to have inherent spring action, as a result of which it is held pressed against the fixed contact part and consequently provides the necessary contact pressure itself.

I claim:

1. A thermal switch comprising:

a thermal bimetallic snap-over disc temperature sensor;

a contact system including a fixed contact assembly and a movable contact assembly, said movable contact assembly including a plastically deformable portion, said movable contact assembly contacting said fixed contact assembly in a quiescent state; and a transmission component, directly contacting said disc and said plastically deformable portion, said transmission component plastically deforming said plastically deformable portion when actuated by said disc, said plastic deformation of said plastically deformable portion breaking contact between said fixed contact assembly and said movable contact assembly.

2. A thermal switch according to claim 1 wherein:

said plastically deformable portion is in contact in a spring manner with said fixed contact assembly in the quiescent state.

3. A thermal switch according to claim 1 or 2 wherein:

said plastically deformable portion is constructed with at least one weak point.

4. A thermal switch according to claim 1 or 2 further comprising:

a spring which presses said plastically deformable portion against said fixed contact assembly in said quiescent state.

5. A thermal switch according to claim 4 wherein:

said plastically deformable portion is constructed with at least one weal point.

6. A thermal switch according to claim 4 wherein:

said spring is constructed with at least one weak point.

7. A thermal switch according to claim 4 wherein:

said spring is constructed with at least one weak point; and said plastically deformable portion is constructed with at least one weak point.

8. A thermal switch according to claim 4 wherein:

said spring is constructed with at least one weak point;

said plastically deformable portion is constructed with at least one weak point; and said spring can be plastically deformed when said transmission component is actuated by said disc.

9. A thermal switch according to claim 4 wherein:

said spring can be plastically deformed when said transmission component is actuated by said disc.

10. A thermal switch according to claim 9 wherein:

said plastically deformable portion is constructed with at least one weak point.

11. A thermal switch according to claim 9 wherein:

said spring is constructed with at least one weak point.

* * * * *